US009856051B2

(12) United States Patent
Caminada

(10) Patent No.: US 9,856,051 B2
(45) Date of Patent: Jan. 2, 2018

(54) DOSING CONTAINER

(71) Applicant: Diversey, Inc., Sturtevant, WI (US)

(72) Inventor: Jeroen Caminada, Voorburg (NL)

(73) Assignee: Diversey, Inc., Sturtevant, WI (US)

( * ) Notice: Subject to any disclaimer, the term of this patent is extended or adjusted under 35 U.S.C. 154(b) by 0 days.

(21) Appl. No.: 15/027,952

(22) PCT Filed: Nov. 14, 2014

(86) PCT No.: PCT/US2014/065770
§ 371 (c)(1),
(2) Date: Apr. 7, 2016

(87) PCT Pub. No.: WO2015/073868
PCT Pub. Date: May 21, 2015

(65) Prior Publication Data

US 2016/0244203 A1 Aug. 25, 2016

Related U.S. Application Data

(60) Provisional application No. 61/904,916, filed on Nov. 15, 2013.

(51) Int. Cl.
*B65D 17/00* (2006.01)
*B65D 75/36* (2006.01)
(Continued)

(52) U.S. Cl.
CPC ..... *B65D 17/24* (2013.01); *A61J 1/067* (2013.01); *B65D 75/366* (2013.01);
(Continued)

(58) Field of Classification Search
CPC ... A61J 1/067; B65D 17/24; B65D 2075/363; B65D 2205/00; B65D 2221/00; B65D 75/366; B65D 75/5811; B67C 11/02
See application file for complete search history.

(56) References Cited

U.S. PATENT DOCUMENTS 3,741,348 A 6/1973 Caputo
3,857,423 A * 12/1974 Ronca, Jr. ..... B65D 47/18 141/319

(Continued)

FOREIGN PATENT DOCUMENTS

| | | |
|---|---|---|
| CN | 10324965 | 8/2013 |
| DE | 8622098 | 1/1987 |
| WO | 98/10993 | 3/1998 |

OTHER PUBLICATIONS

International Search Report, PCT/US2014/065770, dated Apr. 9, 2015.

(Continued)

*Primary Examiner* — Frederick C Nicolas
*Assistant Examiner* — Bob Zadeh
(74) *Attorney, Agent, or Firm* — Michael Best & Friedrich LLP

(57) ABSTRACT

A container including a reservoir to store a dispensable material and an elongated neck that extends from the reservoir and that terminates at a distal end. The container also includes a frangible region intermediate the reservoir and the distal end of the elongated neck. The frangible region is fracturable in response to a predetermined force applied to the distal end to create opening in the elongated neck through which the material can be dispensed from the reservoir. The container further includes a guard disposed adjacent the elongated neck to inhibit inadvertent fracture of the frangible region absent the predetermined force.

16 Claims, 4 Drawing Sheets

(51) Int. Cl.
*A61J 1/06* (2006.01)
*B65D 75/58* (2006.01)
*B67C 11/02* (2006.01)

(52) U.S. Cl.
CPC .... *B65D 75/5811* (2013.01); *B65D 2075/363* (2013.01); *B65D 2205/00* (2013.01); *B65D 2221/00* (2013.01); *B67C 11/02* (2013.01)

(56) References Cited

U.S. PATENT DOCUMENTS 3,913,734 A * 10/1975 Siegel ..... B65D 75/366 206/459.5
4,140,409 A 2/1979 DeVries
4,209,096 A * 6/1980 Carkhuff ..... B65D 75/366 206/469
5,509,898 A * 4/1996 Isono ..... A61J 1/2093 128/DIG. 24
6,244,467 B1 * 6/2001 Lewit ..... B65D 55/16 222/107
6,666,359 B2 * 12/2003 Lau ..... A61J 1/067 222/541.5
6,874,665 B2 * 4/2005 Doherty ..... B65D 1/0238 215/48
D715,637 S * 10/2014 Caminada ..... D9/416
2007/0228073 A1 * 10/2007 Mazzarino ..... B65D 75/5811 222/107
2008/0123465 A1 5/2008 Heusser et al.
2009/0205998 A1 * 8/2009 Klaus ..... B65D 75/5811 206/592
2010/0213197 A1 * 8/2010 Stuart ..... B65D 75/5811 220/553
2012/0145567 A1 * 6/2012 Nguyen ..... B65D 75/326 206/63.5
2013/0084367 A1 * 4/2013 Caldwell ..... B65D 75/563 426/122
2016/0113377 A1 * 4/2016 Moussion ..... A61M 35/003 401/132
2016/0244203 A1 * 8/2016 Caminada ..... B65D 17/24

OTHER PUBLICATIONS

Written Opinion, PCT/US2014/065770, dated Apr. 9, 2015.
EP14861309.4 Partial Supplementary European Search Report dated May 15, 2017 (16 pages).
First Office Action from the State Intellectual Property Office of China for Application No. 201480062507.8 dated Mar. 30, 2017 (14 pages).

* cited by examiner

DOSING CONTAINER

CROSS-REFERENCE TO RELATED APPLICATIONS

This application claims priority to U.S. Provisional Application Ser. No. 61/904,916, filed Nov. 15, 2013, the entire contents of which are hereby incorporated by reference.

BACKGROUND

The present invention relates to dispensing containers, and more particularly to disposable dosing containers.

Containers typically include a body defining a cavity for receiving material and a lid or cover that seals the cavity. In some containers, the cover is removably coupled to the body by a mechanical interconnection, such as a snap-fit connection or threaded connection. Other containers can be configured so that the connection between the cover and the body can be fractured with a directed application of force.

SUMMARY

The invention provides, in one aspect, a container including a reservoir to store a dispensable material and an elongated neck that extends from and is fluidly connected to the reservoir. The container also includes a frangible region intermediate the reservoir and a distal end of the elongated neck. The frangible region is fracturable in response to a predetermined force applied to the distal end to create an opening through which the material may be dispensed from the reservoir. A guard is positioned on the container adjacent the frangible region to inhibit inadvertent fracture of the frangible region absent the predetermined force.

In another aspect, the container includes a reservoir, an elongated neck extending from and fluidly connected to the reservoir, a frangible region intermediate the reservoir and a distal end of the elongated neck, and a passageway that has a first end proximate the frangible region and a second end in fluid communication with the reservoir. The passageway is in fluid communication with air surrounding the container in response to fracturing of the frangible region to supply make-up air into the reservoir when the material is dispensed from the reservoir.

In another aspect, the invention provides a container including a backing, a package defining a reservoir to store a dispensable material, and a frangible region disposed on the package and fracturable in response to a predetermined force applied to a portion of the package. The backing cooperates with the package to seal the reservoir, and fracture of the frangible region generates an opening in the package through which the material may be dispensed from the reservoir. The backing resists fracture of the frangible region absent the predetermined force on the frangible region.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

FIGS. 1-5D illustrate a dosing container or package 10 for storing and selectively dispensing a predetermined quantity of material. The material may be any dispensable material and may include, for example, a concentrated cleaning fluid or powder mixable with a diluent to form a cleaning solution.

Figure 1:
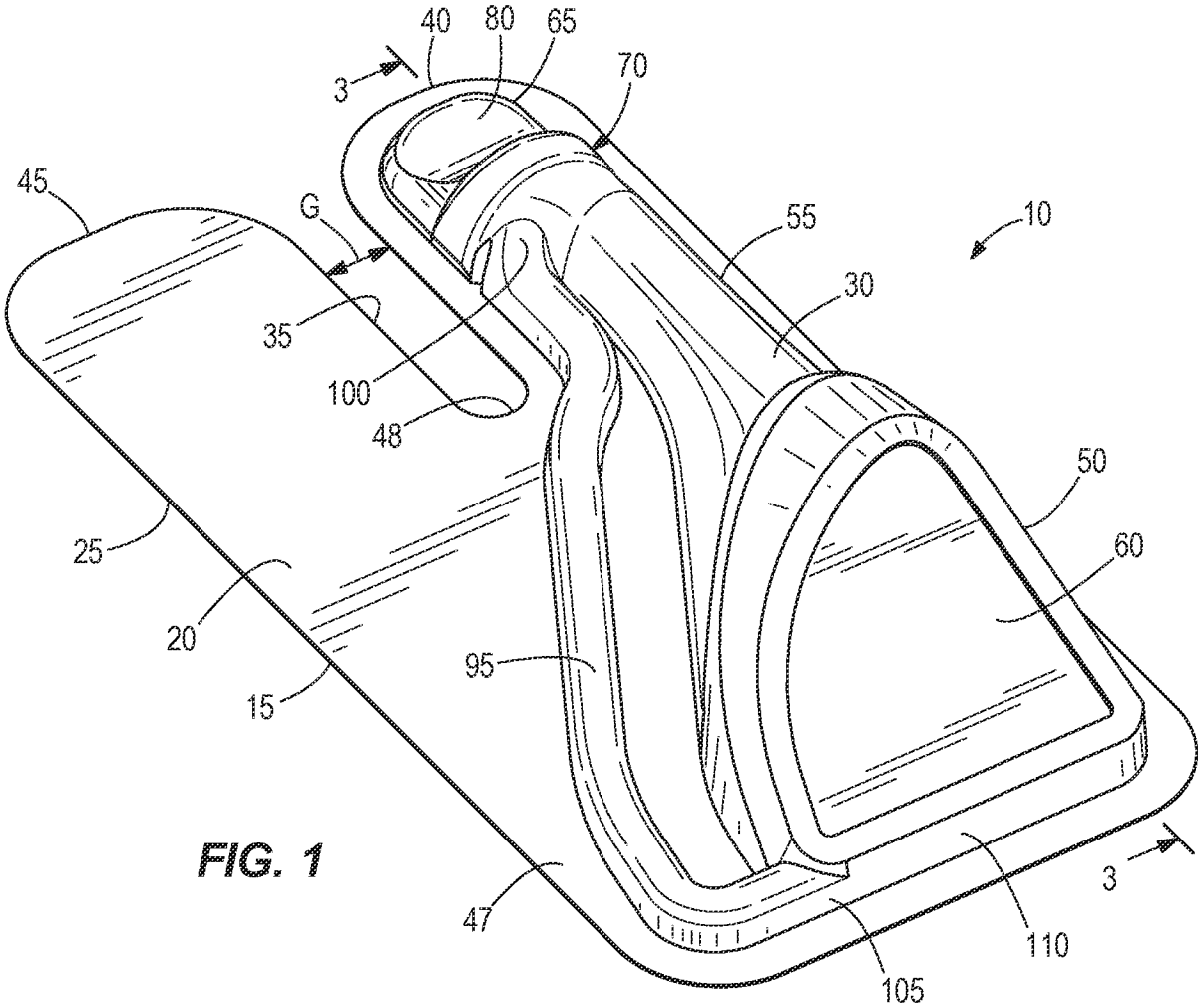
FIG. 1 is a perspective view of a dosing container embodying the invention.
Figure 2:
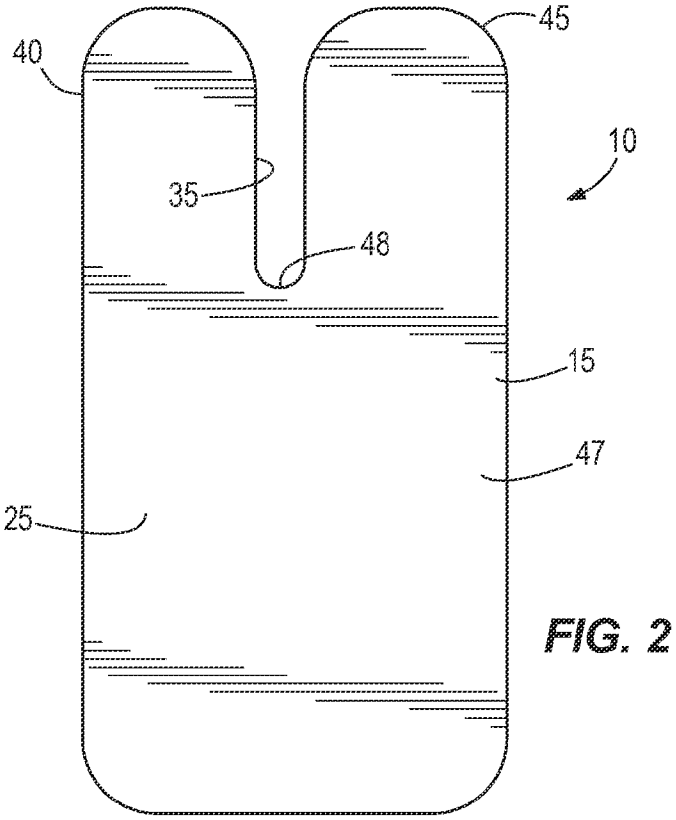
FIG. 2 is a rear view of the dosing container of FIG. 1.

Referring to FIGS. 1 and 2, the container 10 includes a backing 15 that has generally planar, first and second opposing sides 20, 25, and an outer shell or package 30 projecting outwardly from the first side 20. The backing 15 includes a notch 35, a first backing portion 40 (e.g., a finger), and a second backing portion 45 (e.g., a finger) separated from the first backing portion 40 by a gap G defined by the width of the notch 35. The first backing portion 40 is joined to the second backing portion 45 at a bridge portion 47 of the backing 15, beginning at an inner end 48 of the notch 35. In the illustrated embodiment, the first and second backing portions 40, 45 extend parallel to one another such that the backing 15 is generally fork-shaped.

The outer shell 30 can be made of thermo-formed or cold-formed plastic and is attached to the backing 15, which may be made of a variety of materials (e.g., plastic, paperboard, metal foil, etc.). In some embodiments, the backing 15 and the shell 30 may be integrally formed together as a single piece by any suitable process or combination of processes (e.g., water-assisted injection molding, blow molding, etc.). To accommodate storage of specific materials within the container 10, an inner coating or layer (not shown) may be applied to the backing 15 and/or the shell 30. The inner coating may act, for example and without limitation, as a sealant, corrosion inhibitor, or oxygen barrier.

Figure 3:
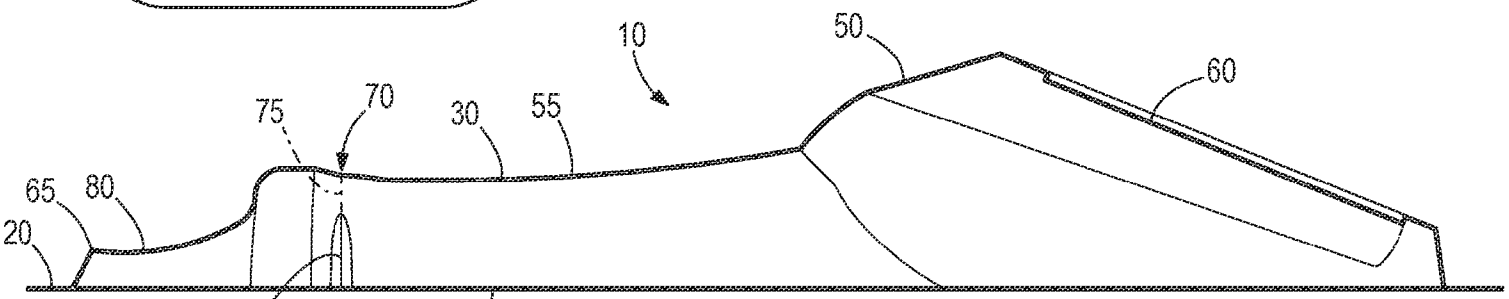
FIG. 3 is a cross-sectional view of the dosing container taken along line 3-3 of FIG. 1.

With reference to FIGS. 1 and 3, the outer shell 30 defines a reservoir 50 for storing the dispensable material and an elongated neck 55 extending from the reservoir 50 along the first portion 40 of the backing 15. In the illustrated embodiment, the reservoir 50 is sized to hold about 10 milliliters of material. In other embodiments, the reservoir 50 may be sized to hold about 20 milliliters of material. In yet other embodiments, the reservoir 50 may be sized to hold between about 10 milliliters and about 100 milliliters of material. The reservoir 50 includes a contoured grip area 60 suitable to accommodate a user's thumb and to facilitate manipulation of the container 10 (e.g., when pouring the material out of the reservoir 50).

Figure 4:
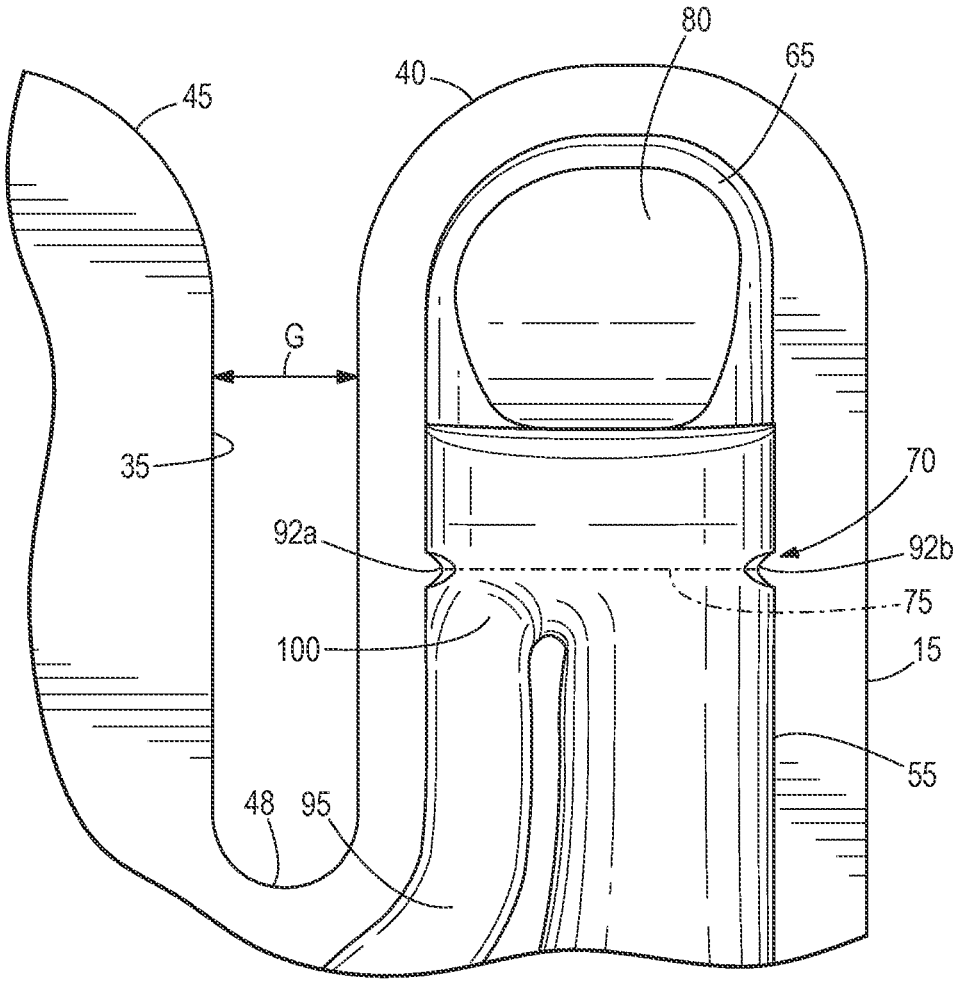
FIG. 4 is an enlarged view of a portion of the dosing container of FIG. 1.
Figure 5B:
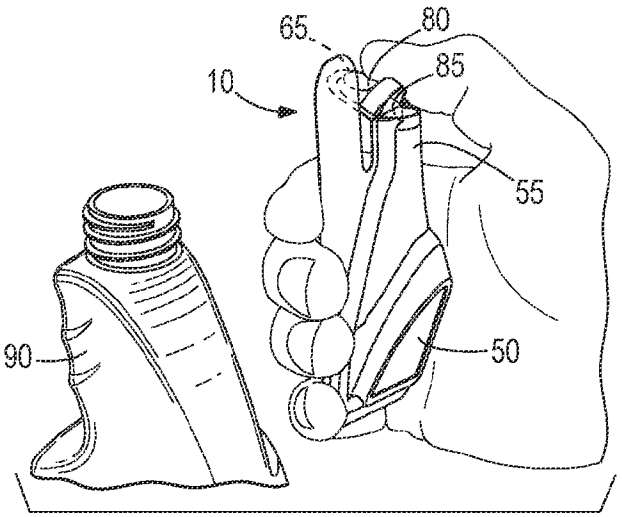
FIGS. 5A-5D illustrate use of the dosing container of FIG. 1.
Figure 5D:
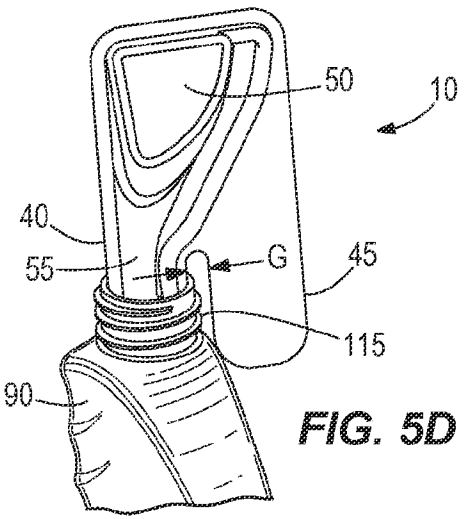
Figure 5A:
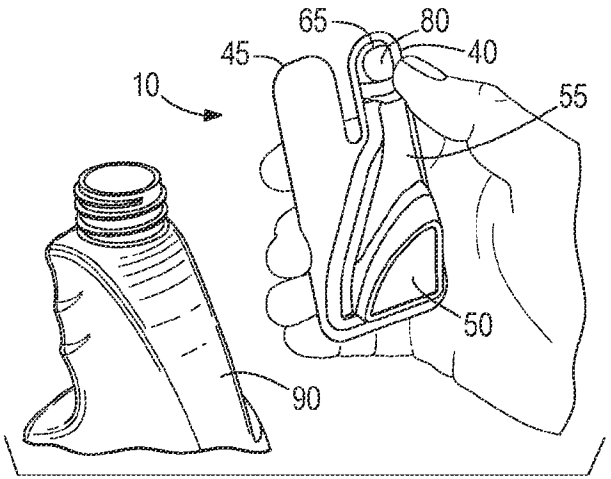
Figure 5C:
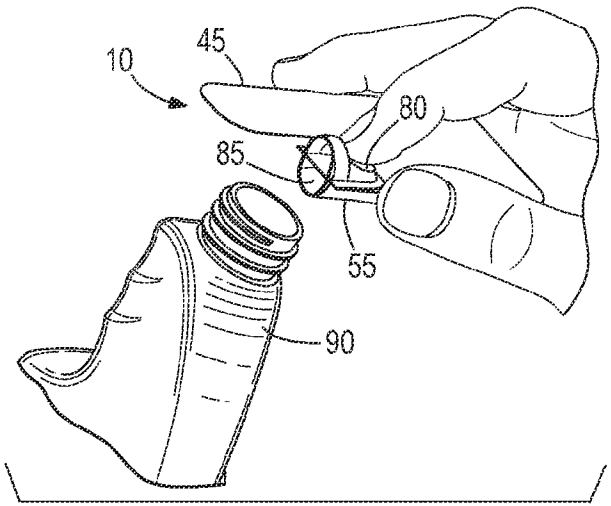

Referring to FIG. 4, the neck 55 includes a distal portion 65 and a frangible region 70 between the distal portion 65 and the remainder of the neck 55. The frangible region 70 is breakable or fracturable across its width along a specified break path 75 when sufficient force is applied to a pressing area 80 defined on the distal portion 65. With reference to FIGS. 5B-5D, fracturing the frangible region 70 creates an opening 85 that permits dispensation of the material from the reservoir 50 into a trigger bottle 90 or other receiving vessel (e.g., a bucket, sink, container, etc.) (for purposes of description and exemplary illustration only, the receiving vessel will be referred to herein as the "trigger bottle 90"). In general, the neck 55 is sized to allow at least partial insertion of the neck 55 into the trigger bottle 90 to minimize splashing or spillage when dispensing the material into the trigger bottle 90 (FIG. 5D). In the illustrated embodiment, the neck 55 is sized to snugly fit within an opening of the trigger bottle 90 that has a diameter greater than or equal to about 22 millimeters. In other embodiments, the neck 55 may be sized other than in a way that provides a snug connection between the container 10 and the bottle 90 or other vessel, depending on a desired application of the container 10.

After the frangible region 70 is fractured, the first backing portion 40 may act as a hinge to permit the distal portion 65 to be folded away from the opening 85 along the plane of the break path 75, while the distal portion 65 remains connected to the rest of the container 10. In some constructions, the break path 75 may extend across the first backing portion 40 such that the distal portion 65 is completely separable from the rest of the container 10.

With continued reference to FIG. 4, the frangible region 70 is bounded by two stress concentrators 92*a*, 92*b* located at opposite ends of the break path 75. The illustrated stress concentrators 92*a*, 92*b* are generally V-shaped notches, although the stress concentrators 92*a*, 92*b* may have any geometry suitable for reliably propagating failure along the break path 75. Also, one or more of the stress concentrators 92*a*, 92*b* can be located inward of the ends of the break path 75 (e.g., toward the middle of the path 75). Generally, one or more stress concentrators 92*a*, 92*b* can be defined along the break path 75 to facilitate a concentration of stress or force so that the frangible region 70 can be fractured along the break path 75.

The container 10 further includes a passageway 95 with a first end 100 proximate the frangible region 70 and a second end 105 that opens into the reservoir 50 at a bottom end 110 (e.g., when viewing the dispensing container 10 from above the container 10 in FIG. 1) of the reservoir 50. As illustrated, the passageway 95 is elongated and extends from adjacent the frangible region 70 to the bottom 110 along the contour of the reservoir 50 (e.g., parallel to the contour of the reservoir 50). The passageway 95 may supply make-up air into the reservoir 50 as the material is being dispensed. If the dispensable material is a liquid, the introduction of make-up air at the bottom end 110 of the reservoir 50 prevents air bubbles from interrupting the flow of material through the opening 85 (i.e. gurgling).

With reference to FIG. 1, the second backing portion 45 acts as a guard to inhibit inadvertent fracture of the frangible region 70 (e.g., during transportation or storage of the container 10). The illustrated second backing portion 45 is positioned laterally opposite relative to the frangible region 70 to inhibit fracture of the frangible region 70 absent a predetermined force on the distal end 65. Stated another way, the backing 15 is forked into first and second backing portions 40, 45 so that when a force is generally applied to the container (i.e. not focused on the frangible region 70), the second backing portion resists bending and fracture of the frangible region 70. A second (e.g., identical) container 10 can be stored or transported back-to-back with the container 10 so that the backing 15 of each container 10 provides extra protection for the frangible region 70 of the other container 10.

As illustrated in FIG. 5D, a peripheral wall 115 of the trigger bottle 90 is positioned or received within the notch 35 between the two side-by-side backing portions 40, 45. As illustrated, the second backing portion 45 balances and stabilizes the container 10 on the trigger bottle 90 to minimize spillage while the material is being dispensed (e.g., with or without someone holding onto the container 10).

One or more of the second side 25, the second backing portion 45, and the shell 30 may include indicia (e.g., branding, logos, instructions, advertisements, etc.). As will be appreciated, the indicia may be raised above the surface to which the indicia is applied, stamped into the surface, applied in some other way.

The container 10 can be opened by holding the backing 15 and the shell 30 in several different ways. For purposes of description, only one exemplary way to open the container 10 will be described in detail. More specifically, and referring to FIG. 5A, the container 10 is opened by a user grasping the container 10 and pressing their thumb against the pressing area 80 (it will be understood that other fingers could be used to apply a force to the distal portion 65). Referring to FIGS. 5B and 5C, the frangible region 70 fractures along the breaking line 75 to produce the opening 85 after an adequate force applied against the pressing area 80. With reference to FIGS. 5C and 5D, the user inverts the container 10 and inserts the neck 55 into the trigger bottle 90 to dispense the material from the reservoir 50. The second backing portion 45 accurately guides the neck 55 into the trigger bottle 90 during insertion into the bottle 90, which decreases the risk of spillage and skin contact with the dispensable material. During dispensation of the material, make-up air flows into the first end 100 of the passageway 95 and into the reservoir 50 to replace the dispensed volume of material. With reference to FIG. 5D, the second backing portion 45 stabilizes the container 10 on and in the trigger bottle 90 until the material is completely dispensed. The user can remove the container 10 after the material has been dispensed.

Various features of the invention are set forth in the following claims.

The invention claimed is:

1. A container comprising:

a reservoir to store a dispensable material;

an elongated neck extending from and fluidly connected to the reservoir;

a frangible region intermediate the reservoir and a distal end of the elongated neck, the frangible region fracturable in response to a predetermined force applied to the distal end to create opening in the elongated neck through which the material is configured to be dispensed from the reservoir;

a guard positioned on the container adjacent the frangible region to inhibit inadvertent fracture of the frangible region absent the predetermined force; and a passageway having a first end disposed proximate the frangible region and a second end in fluid communication with the reservoir, wherein the passageway is elongated and extends from adjacent the frangible region to a bottom of the reservoir.

2. The container of claim 1, further comprising a planar backing including a first backing portion and a second backing portion laterally separated from the first backing portion by a notch.

3. The container of claim 2, wherein the elongated neck is coupled to the first backing portion, and wherein the guard is at least partially defined by the second backing portion.

4. The container of claim 1, wherein the frangible region includes a break path extending across a width of the elongated neck.

5. The container of claim 4, wherein the frangible region includes a first stress concentrator and a second stress concentrator, and wherein the break path extends between the first and second stress concentrators.

6. The container of claim 5, wherein the first and second stress concentrators are defined by V-shaped notches.

7. A container comprising:

a reservoir to store a dispensable material;

an elongated neck extending from and fluidly connected to the reservoir;

a frangible region intermediate the reservoir and a distal end of the elongated neck, the frangible region fracturable in response to a predetermined force to create an opening through which the material is configured to be dispensed from the reservoir; and a passageway having a first end proximate the frangible region and a second end in fluid communication with the reservoir, wherein the passageway is elongated and extends from adjacent the frangible region to a bottom of the reservoir and is in fluid communication with air surrounding the container in response to fracturing of the frangible region to supply make-up air into the reservoir when the material is dispensed from the reservoir.

8. The container of claim 7, further comprising a guard positioned laterally opposite the frangible region to inhibit fracture of the frangible region absent the predetermined force on the distal end.

9. The container of claim 8, further comprising a planar backing including a first backing portion and a second backing portion separated from the first backing portion by a notch.

10. The container of claim 9, wherein the elongated neck is at least partially disposed on the first backing portion, and wherein the guard is at least partially defined by the second backing portion.

11. The container of claim 7, wherein the frangible region includes a break path extending across a width of the elongated neck, wherein the frangible region includes a first stress concentrator and a second stress concentrator, and wherein the break path extends between the first and second stress concentrators.

12. The container of claim 11, wherein the first and second stress concentrators are generally V-shaped notches.

13. A container comprising:

a backing;

a package defining a reservoir to store a dispensable material; and a frangible region disposed on the package and fracturable in response to a predetermined force applied to a portion of the package, wherein the backing cooperates with the package to seal the reservoir, wherein fracture of the frangible region generates an opening in the package through which the material is configured to be dispensed from the reservoir, and wherein the backing resists fracture of the frangible region absent the predetermined force on the frangible region;

wherein the backing has a notch and the notch is positioned adjacent the package to receive a portion of a vessel into which the material can dispensed, and wherein the container is cooperatively held in an inverted position by the backing and the notch upon receipt of the portion of the vessel within the notch.

14. The container of claim 13, wherein the frangible region includes a break path extending across a width of the package.

15. The container of claim 14, wherein the frangible region includes a stress concentrator positioned along the break path, and wherein the stress concentrator focuses the predetermined force along the break path.

16. The container of claim 13, further comprising a guard positioned laterally opposite the frangible region, wherein the backing includes a first backing portion positioned to seal a portion of the package and a second backing portion laterally offset from the first backing portion, and wherein the guard is at least partially defined by the second backing portion.

* * * * *